US006481170B1

(12) United States Patent
Savenok et al.

(10) Patent No.: US 6,481,170 B1
(45) Date of Patent: Nov. 19, 2002

(54) SYSTEM AND METHOD FOR ATTACHING ARCHITECTURAL MOLDINGS AND INSULATION SHEETS TO BUILDINGS

(75) Inventors: Pavel Savenok, Wheaton, IL (US); Vitaliy Savenok, Wheaton, IL (US); Vladimir Savenok, Carol Stream, IL (US); Peter Klyachenko, St. Charles, IL (US)

(73) Assignee: Stucco Molding, Inc., Wheaton, IL (US)

( * ) Notice: Subject to any disclaimer, the term of this patent is extended or adjusted under 35 U.S.C. 154(b) by 0 days.

(21) Appl. No.: 09/255,512

(22) Filed: Feb. 22, 1999

Related U.S. Application Data

(60) Provisional application No. 60/086,685, filed on May 22, 1998.

(51) Int. Cl.[7] ..... E04L 2/38

(52) U.S. Cl. ..... 52/288.1; 52/309.9; 52/309.16; 52/717.02; 52/717.04; 52/717.05; 52/718.01; 264/45.1; 264/46.4; 428/223

(58) Field of Search ..... 52/309.4, 309.7, 52/309.8, 309.9, 309.11, 309.14, 287.1, 288.1, 312, 717.01, 717.05, 718.02, 717.04, 204.53, 211, 309.16, 717.02; 428/223, 247, 319.1, 318.4, 192; 264/45.1, 46.4

(56) References Cited

U.S. PATENT DOCUMENTS

| | | | | | |
|---|---|---|---|---|---|
| 3,714,747 | A | * | 2/1973 | Curran | |
| 3,979,867 | A | * | 9/1976 | Sowinski | 52/309 |
| 4,059,933 | A | * | 11/1977 | Funk et al. | 52/127 |
| 4,150,517 | A | * | 4/1979 | Warner, Sr. | 52/288 |
| 4,277,526 | A | * | 7/1981 | Jackson | 428/31 |
| 4,283,894 | A | * | 8/1981 | Raty | 52/311 |
| 4,648,225 | A | * | 3/1987 | Waddell | 52/288 |
| 4,653,246 | A | * | 3/1987 | Hepler | 52/787 |
| 5,179,811 | A | * | 1/1993 | Walker et al. | 52/287 |
| 5,242,734 | A | * | 9/1993 | Rubin | 428/100 |
| 5,359,817 | A | * | 11/1994 | Fulton | 52/288.1 |
| 5,433,048 | A | * | 7/1995 | Strasser | 52/288.1 |
| 5,561,961 | A | * | 10/1996 | Paul | 52/716.7 |
| 5,819,485 | A | * | 10/1998 | Lane et al. | 52/287.1 |
| 5,836,134 | A | * | 11/1998 | Couto et al. | 52/718.02 |
| 5,890,267 | A | * | 4/1999 | Neuhofer, Jr. | 24/295 |
| 5,979,132 | A | * | 11/1999 | Margarit | 52/312 |

* cited by examiner

*Primary Examiner*—Yvonne M. Horton
(74) *Attorney, Agent, or Firm*—Lloyd L. Zickert

(57) ABSTRACT

A system for attaching architectural molding or insulation sheets to buildings or other structures which uses headed fasteners that bear against strips of substantially rigid material embedded in the molding or sheets that include a foam plastic core optionally covered with a hard base coat of cementitious material.

27 Claims, 3 Drawing Sheets

SYSTEM AND METHOD FOR ATTACHING ARCHITECTURAL MOLDINGS AND INSULATION SHEETS TO BUILDINGS

This application claims the benefit of U.S. provisional application Ser. No. 60/086,685, filed May 22, 1998.

This invention relates to a system for attaching architectural molding or insulation sheets to buildings, and more particularly to attaching architectural moldings formed from a light foam plastic core covered with a hard base coat or insulation sheets of light foam plastic to an exterior substrate or wall of a building or structure using fasteners that bear against an insert or strip that extends through the moldings or sheets.

BACKGROUND OF THE INVENTION

Within the last few years, the use of light-weight prefabricated architectural moldings or shapes for application to the exterior walls of buildings has increased. Such moldings are used to enhance the aesthetic beauty of a surface area. These moldings are constructed of a light-weight plastic material covered by a hard protective base coat. A finish coat also is usually applied over the base coat once they are attached to a wall or substrate of the building structures.

Heretofore, in order to secure the molding to the structures, the shapes were adhesively attached to the substrates or walls of the structures. However, moisture often accumulated between the moldings and the substrate, thereby eroding the adhesive and causing separation of the molding from the substrate. Where it would be desired to apply the molding to a wall of a building covered with a moisture barrier type plastic sheeting, various fasteners thus were employed.

One type of fastener is a nail or screw with a large plastic washer. The large plastic washer is designed to be pressed into the molding until it is at least slightly below the surface so the opening created in the base coat can be filled, thereby creating a generally flat outer surface. However, the large size of the washers and hardness of the coating on the moldings often caused the coating to crack, thereby requiring repair or replacement. Furthermore, because of the large area necessary to be recoated due to the size and effect of the washer, variations in shading sometimes were present on the moldings after the finish coat was applied.

It has also been known to use adhesives or washers and screws, separately or in combination, to attach insulation sheets to buildings. Installing insulation sheets, which usually are 2 feet by 4 feet sheets, with such fastening systems often led to the same or similar problems as encountered in the mounting of moldings as above mentioned.

SUMMARY OF THE INVENTION

The present invention overcomes the problems in securing architectural molding to substrates on structures or insulation sheets to buildings. The molding of the present invention includes a core of light plastic material covered by a skin of hard, preferably cementitious, material. A fastening strip of substantially rigid material is embedded within the core of light plastic material. To mount the molding onto the substrate of the structure, the molding is placed against the structure in the desired location. Then, fasteners, such as drywall screws, are inserted completely through the hard skin or base coat into the core and through the strip in the core of the molding and into the substrate of the structure until the heads of the screws abut and press against the strip. If desired, prior to fastening, a small hole formed through the skin and into the core can be made by a drill or other device for facilitating the use of fasteners.

The use of fasteners such as screws allows the molding to be securely attached to the substrate of the structures. Furthermore, using fasteners with pointed ends allows for the screw to penetrate the hard base coat or skin and the molding by forming a small hole in the skin and core to the strip and without causing appreciable damage to the base coat or molding. Thereafter, the small holes can be filled very easily with a suitable material.

Similarly, insulation sheets of the present invention include at least one fastening strip of substantially rigid material embedded within the sheet. The sheets are then mounted onto a building by inserting fasteners through the sheets and strip and into the building. The strips may be sized and arranged to interlock adjacent sheets.

It is therefore an object of the present invention to provide architectural molding and insulation sheets that may be easily and securely attached to substrates of structures and/or buildings.

Another object of the invention is to provide for attaching architectural molding without causing appreciable damage to the base coat or skin of the molding or the molding itself.

A further object of the invention is to provide for attaching insulation sheets without causing appreciable damage to the sheets.

Other objects, features and advantages of the invention will be apparent from the following detailed disclosure, taken in conjunction with the accompanying sheet of drawings, wherein like reference numerals refer to like parts.

DESCRIPTION OF THE INVENTION

Figure 1:
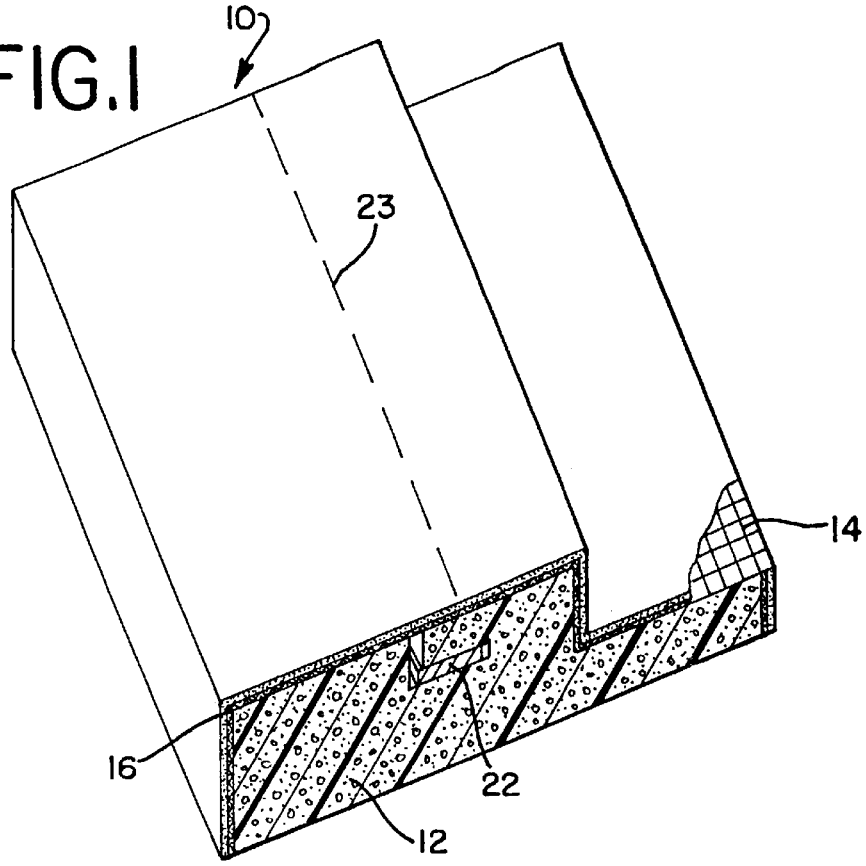
FIG. 1 is a perspective view of one variation in shape of architectural molding of the present invention.

Referring now to the drawings, FIGS. 1 to 4 show one design shape for the architectural molding of the present invention, generally indicated by the numeral 10. The molding 10 includes a core of light-weight plastic material 12 with a base wall, an outer formed face, a slot or channel 20, a reinforcing mesh 14, and a base coat 16. The plastic material 12 is preferably any suitable foam plastic (sometimes called cellular plastic) having light-weight and good strength characteristics, such as foam polystyrene or Styrofoam plastic having a desired rigidity, but may be any other type of suitable light-weight plastic material. Styrofoam is a trademark of Dow Chemical Co., and constitutes an expanded cellular polystyrene. The desired shape of the plastic material 12 may be prefabricated or it may be formed by cutting the shape from a foam plastic block. A mesh 14 is located on top of the desired shape of the plastic material 12 to reinforce the base coat 16. Preferably, the mesh 14 is a 4.5 ounce standard fiberglass woven mesh. The base coat 16 which is applied over and to embed the mesh 14 is comprised of a suitable cementitious material, such as a hydraulic cement, which when cured forms a hard outer surface for the molding to protect the molding 10 from outside elements, for example, moisture, and which may receive any suitable finish coat.

Figure 2:
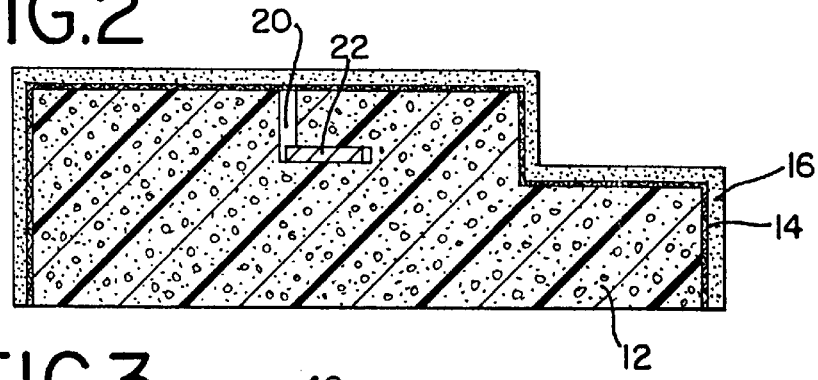
FIG. 2 is a vertical plan side view of the same variation of architectural molding of the present invention.
Figure 3:
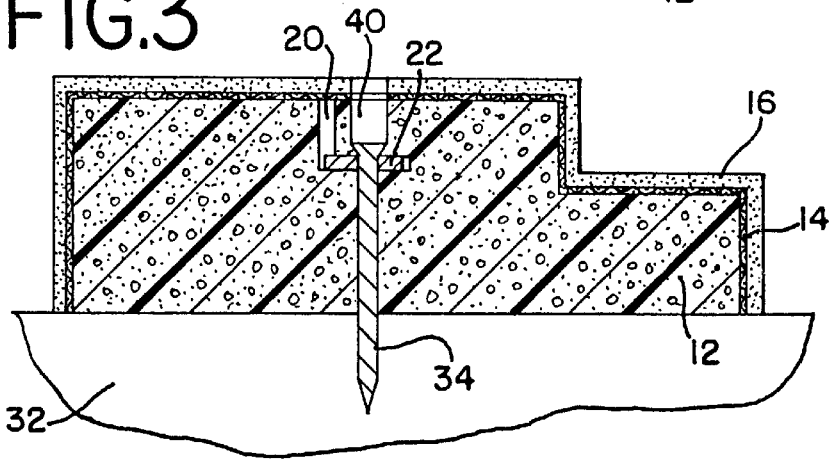
FIG. 3 is a cross-sectional view of the same variation of architectural molding of the present invention fastened to a wall or substrate of a structure.

As shown in FIGS. 1 to 3, a slot or channel 20 is formed inside the core of the plastic material 12. The slot 20 may be formed by moving an L-shaped hot wire through the plastic material 12 before applying the base coat 16, or it may be formed by any other suitable means, such as molding or cutting. A hot wire (not shown) passed through the length of the molding 10 forms an L-shaped channel or slot 20 in the molding 10. The mesh 14 and base coat 16 may then be applied over the plastic material 12 to seal off the top end of the slot 20.

Once the slot 20 is formed, a strip of rigid material 22 is then inserted into the slot 20. The size of the slot may be such that the strip may be easily inserted. The strip 22 is preferably a polyurethane, or polycarbonate resinous material such as that marketed under the trademark Lexan, but may be made of any suitably rigid material, such as wood, metal or other plastic. Lexan is a trademark owned by General Electric Corporation.

Figure 4:
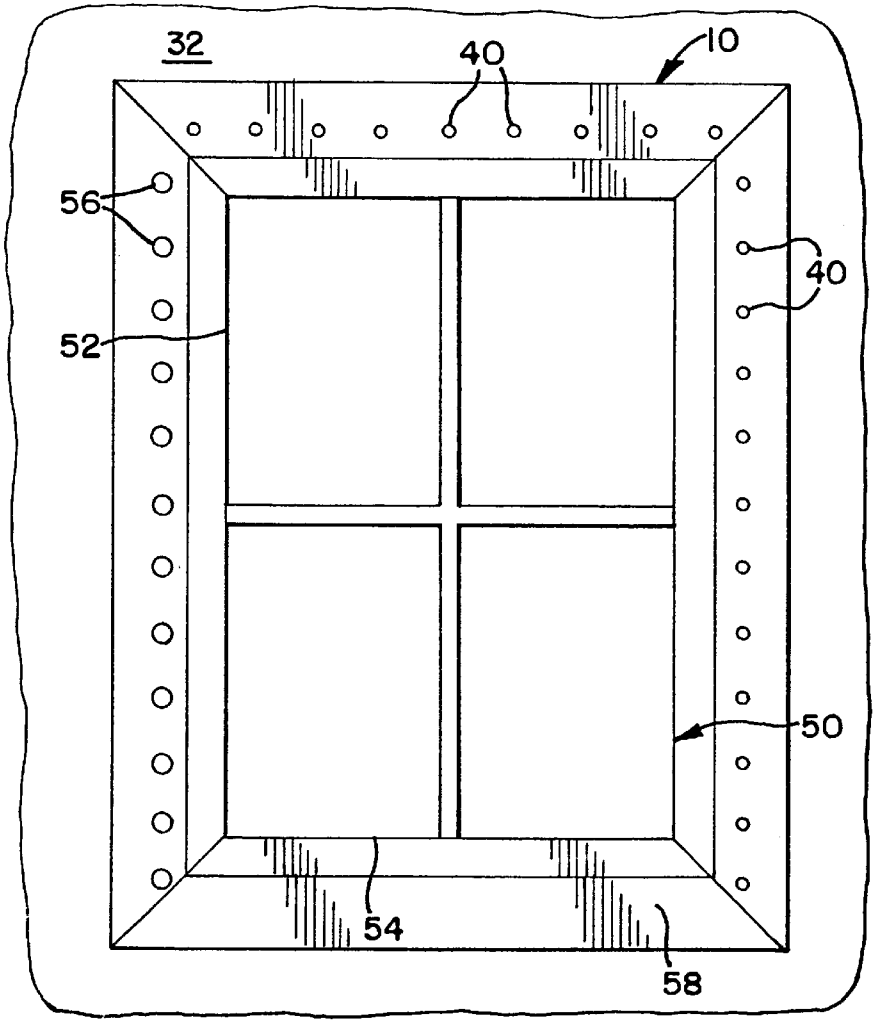
FIG. 4 is a vertical plan view of the same variation of architectural molding of the present invention fastened around a window.

In application, the molding 10 is placed into its desired location against a suitable substrate or wall. While the molding 10 in FIG. 4 is shown placed on the exterior wall of a building around a window 50, it should be appreciated that the molding 10 may be used in numerous places, including around doors, on columns or facia, both exteriorly and interiorly. The molding 10 may be initially held in its desired place by hand or other means, such as an adhesive. Once the molding 10 is in its desired place, a plurality of fasteners, such as drywall screws 34 are inserted into the molding 10. Such screws generally include a beveled head and a threaded shank. In terms of a screw 34, the screw is placed on the molding in alignment with the strip 22 such that it will pass through the strip 22 and into the substrate of the structure 32. In order to facilitate the proper placement and positioning of the screw before it is driven through the molding, a line or other suitable marking or indicia may be used on the top of the base coat 16 of the molding 10 such as a dashed line 23 shown in FIG. 1. The screw 34 may be inserted until the beveled head of the screw 34 contacts and bears tightly against the strip 22 in the core of the plastic material 12. The molding 10 will then be securely fastened to the substrate of the structure 32.

Although the length of the strip 22 can vary, the strip preferably should be sized to extend substantially the full length of the molding. The strip should also be of sufficient width to allow for the fasteners 34 to have sufficient area to pass through the interior section of the strip 22 and also to define the appropriate bearing contact with the foam plastic core 12. It is also desired that the strip 22 has a sufficient width to press against a sufficiently broad part of the plastic core material 12 of the shape or molding 10 when the fastener 34 contacts or bears against the strip 22 to prevent the strip from penetrating the core material or moving through the material, whereby the molding 10 will be securely fastened to the substrate of the structure 32. For example, it is known that a strip 22 having a width of about one inch (2.54 cm) and a thickness of about one-eighth inch (3.5 mm) may be used on the molding 10 shown in FIGS. 1 to 4 having a width of about nine inches (22.86 cm).

As shown in FIG. 3 and FIG. 4, small holes 40 will be formed in the base coat 16 and the upper portion of the plastic material 12 where the screw 34 has passed. The holes 40 may be filled with cementitious material or other suitable material such as caulking, and smoothed as shown at 56 on the section of molding 10 on the left-hand side 52 of the window 50 in FIG. 4. If desired, a finish coat may then be applied over the base coat 16, or over the holes 40 themselves, to form a uniform surface, as shown at 58 below the bottom part 54 of the window 50 in FIG. 4. A suitable finish coat is preferably an acrylic-based material with a stone aggregate, but may be any other suitable type of finish coat. The finish coat, which may be up to one-quarter inch thick, may be applied by spraying or troweling the material onto the base coat, and then allowed to cure.

Figure 5:
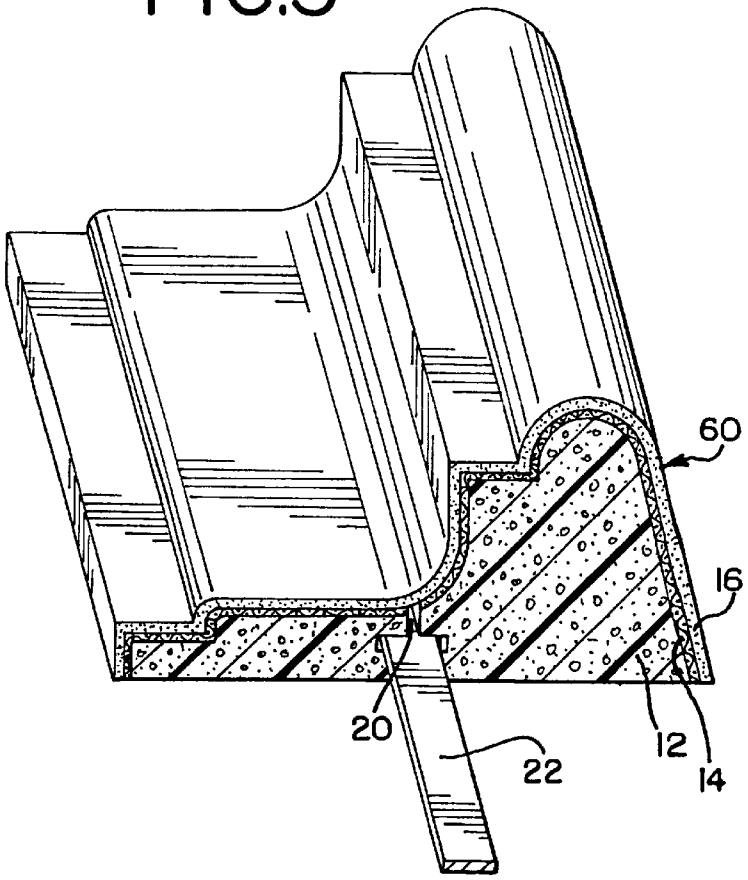
FIG. 5 is an isometric view of another embodiment of architectural molding of the present invention with the strip partially inserted into the molding.

Another architectural design shape for a molding, generally indicated by the numeral 60 is shown in FIG. 5. This embodiment also more clearly demonstrates the insertion of the strip 22 into the core of the molding 10. It should be appreciated that this invention may be used with any of the numerous shapes of architectural moldings or other designs such as desired on imitation stucco surfaces.

It should also be appreciated that the system of attaching a molded foam plastic trim piece to a structure may also be used without providing the trim piece with an outer hard base coating. Such a base coat of cementitious material, along with any finish coat or coats may be applied at the building site. The attaching system of the present invention is an improved system over the prior art systems identified in the Background of the Invention.

Figure 6:
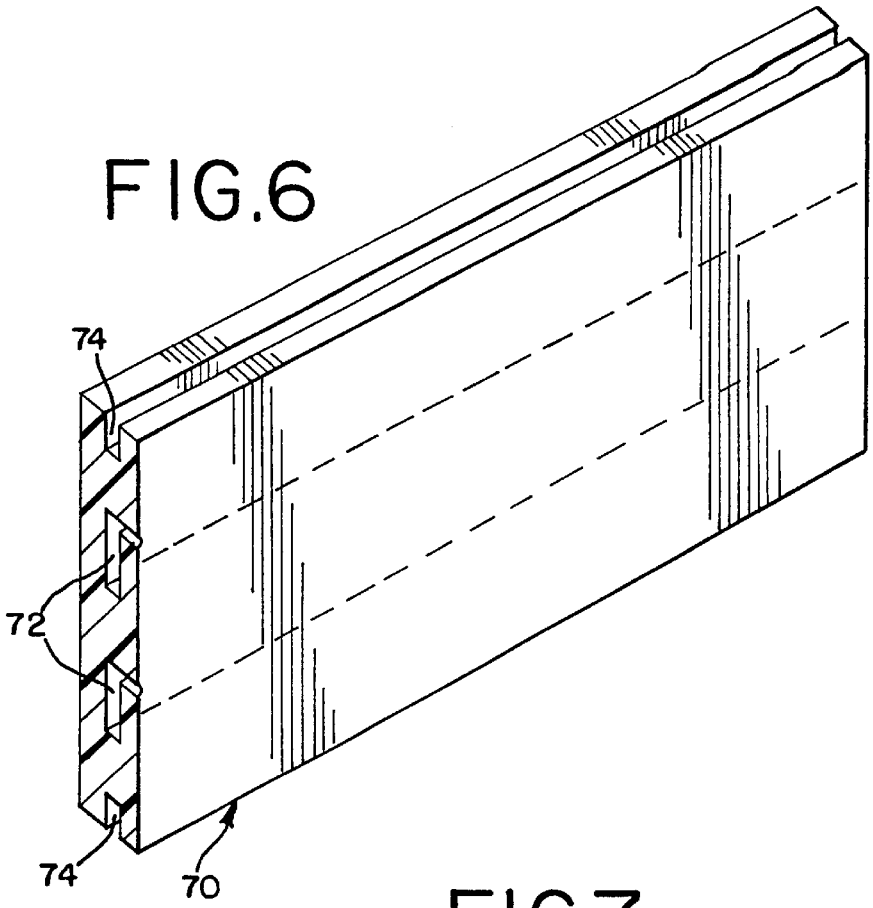
FIG. 6 is a perspective view of a sheet of insulation formed with channels for receiving fastening strips.
Figure 7:
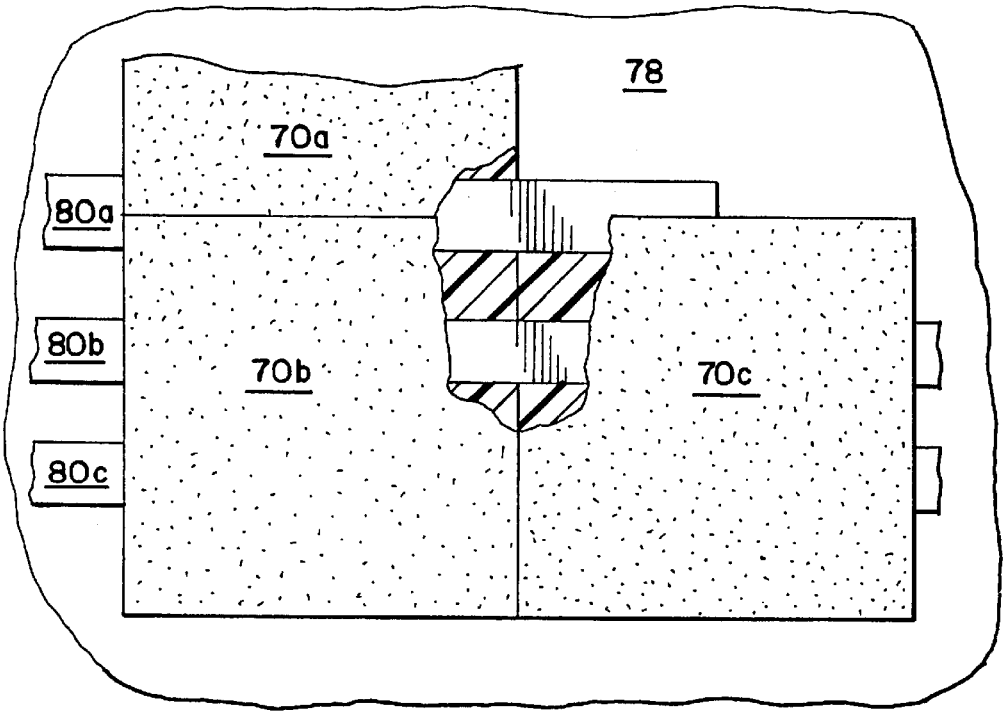
FIG. 7 is an elevational view of a plurality of sheets of material and fastening strips with some parts broken away to show underlying parts.

Referring now to FIGS. 6 and 7, insulation sheets 70 or panels utilizing the attaching system of the invention are shown. The insulation sheets 70 are generally made of a suitable foam plastic, such as Styrofoam plastic. The system includes the formation in each sheet 70 of a plurality of longitudinally extending slots or channels 72 and/or U-shaped channels 74. The slots may be formed using a hot wire, or using any other suitable means, such as molding or cutting. The slots or channels 72 extend longitudinally through the central area of a sheet, while U-shaped channels 74 forming about one-half of a full channel may be formed on the edges of the sheets 70 so that a complete slot may be formed where another sheet with a similar but opposing U-shaped channel 74 is placed on top of the edge of the sheet, as shown in FIG. 7.

Once the slot is formed, strips like those in FIGS. 3 and 4 may be inserted into each of the slots 72 and the edge channels 74. The strips 80*a*, 80*b* and 80*c* may also be of such a length to extend entirely through one sheet and into one or more adjacent sheets of material. Thus, adjacent sheets may be interconnected or interlocked to one another. Furthermore, the channels 74 on the edges of the sheets 70 serve to receive a fastening strip 80*a*, 80*b* and 80*c* to interconnect or interlock the adjacent sheets together along their longitudinal edges.

It should be appreciated that any number of channels may be provided in a sheet, and that the edge channels may be omitted. Further, the channels may extend horizontally or vertically, but preferably parallel to an edge of the sheet.

To secure the insulation sheet 70 to a building, the sheet 70 is first placed against the building in its desired location. The sheet 70 may be held in place by hand or by other means, such as using adhesive. Once in place, a plurality of fasteners such as screws are inserted into the sheet 70 such that they will pass through the strip 68 and into the building. Lines or other marking or indicia means may be used to facilitate the proper placement of the screws. The screws are then driven into the substrate or wall on which the sheets are mounted until the screw heads engage and press against the fastening strips. The holes formed by the screws may be filled with a suitable material if desired. After the insulation sheets are secured to the wall, a mesh and coating are generally applied to the surface of the insulation sheets. As seen in FIG. 7, a plurality of insulation sheets or panels are mounted on a wall 78 to illustrate the interlocking of adjacent sheets and provide an interlocked layer of insulation. The sheets are generally rectangular and would normally be two feet by four feet in size and of any suitable thickness. Sheets 70*a*, 70*b* and 70*c* are illustrated as being interlocked together by fastening strips 80*a*, 80*b* and 80*c*. Strips 80*b* and 80*c* extend through channels in sheets 70*b* and 70*c* to interlock and align sheets 70*b* and 70*c*. Strips 80*b* and 80*c* also extend beyond sheets 70*b* and 70*c* to provide an interlocking relation with other sheets that may be attached to wall 78 in adjacent relation thereto. Strip 80*a* fits in edge channels of sheets 70*a* and 70*b* to interlock the edges of the vertically arranged sheets. While sheet 70*a* is aligned with sheet 70*b*, it could be appreciated they may be arranged in staggered relation.

From the foregoing, it can be appreciated that the invention provides an improved system of attaching foam plastic moldings or insulation sheets to walls or substrates.

It will be understood that modifications and variations may be affected without departing from the scope of the novel concepts of the present invention, but it is understood that this application is to be limited only by the scope of the appended claims.

The invention is hereby claimed as follow:

1. A unit of construction material for attachment to a building, wherein said unit includes a body having a core of light-weight material having a plurality of sides, a back wall, and a top wall, means for mounting said unit onto said building with fasteners having heads and shanks such that the back wall of the unit directly contacts an exterior or interior surface of the building, said mounting means including an elongated strip of substantially rigid material entirely embedded in said core against which a head of a fastener is adapted to contact when extending the shanks of the fasteners first through the core and then through the strip of material and into the building until the heads abut the strip for attaching the body to the building.

2. The combination according to claim 1, wherein the unit comprises an insulation sheet for attachment to a building or structure formed of light-weight plastic material, and said sheet includes a rectangularly shaped body.

3. The combination according to claim 2, wherein said mounting means further includes at least one other insulation sheet and means to interconnect said insulation sheet to said at least one other insulation sheet, wherein said other insulation sheet has a body and four sides.

4. The combination according to claim 3, wherein the interconnection means includes edge channels in at least one of said four sides of said body of said insulation sheet and one of said four sides of said body of said at least one other insulation sheet.

5. The combination according to claim 4, wherein said edge channels are U-shaped channels.

6. A method of making an architectural molding for attachment to a substrate of an interior or exterior structure by fasteners, comprising the steps of:

forming a plastic material into a decorative cross-sectional body with a base wall and an outer formed face;

forming a longitudinally extending channel within said body parallel to said base wall;

coating said outer formed face with a substantially rigid material; and inserting a strip of substantially rigid material entirely into said channel to receive said fasteners for attaching said body to said substrate.

7. The method of claim 6, wherein said step of coating said outer formed face includes the step of:

placing a mesh over said outer formed face; and applying a layer of substantially rigid material over said wire mesh.

8. The method of claim 6, wherein the step of forming a longitudinally extending channel includes passing an L-shaped hot wire through at least part of said body.

9. The method of claim 6, wherein said method further includes the step of marking said coating to facilitate the proper insertion of said fasteners into said body such that said fasteners penetrate said strip of substantially rigid material.

10. The method of claim 7, wherein the mesh is wire.

11. The method of claim 7, wherein the mesh is fiberglass.

12. A method for attaching a unit of construction material adapted to engage a building, wherein the unit includes a body of light-weight plastic having a plurality of sides, a back wall, and a top wall, said method comprising: embedding an elongated strip of rigid material entirely in said body, mounting said unit on the building such that the back wall of the unit directly contacts an exterior or interior surface of the building, and applying fasteners having heads and shanks through the body and strip of rigid material and in engagement with the building and where the heads of the fasteners contact and bear against said strip and said shanks extend first through the body, then the strip and into the building thereby attaching the unit to the building.

13. The method for attaching units according to claim 12, wherein the method further comprises the step of marking the unit to facilitate location of headed fasteners for insertion into the body such that the heads of the fasteners may contact and be supported by the strip.

14. The method of claim 13, wherein said step of marking the unit includes applying a line to the outer surface of the body in alignment with said strip.

15. A unit of construction material for attachment to a building, wherein said unit includes a body having a core of light-weight material having a plurality of sides, a back wall, and a top wall, means for mounting said unit onto said building with headed fasteners such that the back wall of the unit directly contacts an exterior or interior surface of the building, said mounting means including an elongated strip of substantially rigid material entirely embedded in said core against which a head of a fastener is adapted to contact when extending the fastener through the unit and strip of material and into the building for attaching the body to the building, said unit of construction material being a molding wherein the molding includes an elongated body having a decorative cross-sectional shape with a base wall and an outer formed face, a coating of substantially rigid material over said outer formed face adapted to be painted or otherwise further coated with a finish material, and said mounting means further including a channel extending in said core of said body substantially parallel to said base wall, whereby said channel receives said strip of substantially rigid material.

16. The combination according to claim 15, wherein said channel is an L-shaped channel formed by passing an L-shaped hot wire through the body.

17. The combination according to claim 16, wherein said body further includes indicia on said coating to facilitate the placement of said headed fasteners into said body such that said headed fasteners pass through said strip of substantially rigid material and the heads of said fasteners bear against said strip.

18. The combination according to claim 17, wherein said indicia is a line.

19. The combination according to claim 18, wherein said line is a dashed line.

20. The combination according to claim 15, wherein said coating comprises a wire mesh and a coating of substantially rigid material.

21. The combination according to claim 20, wherein said coating of substantially rigid material is a cementitious material.

22. A unit of construction material for attachment to a building, wherein said unit includes a body having a core of light-weight material having a plurality of sides, a back wall, and a top wall, means for mounting said unit onto said building with headed fasteners such that the back wall of the unit directly contacts an exterior or interior surface of the building, said mounting means including an elongated strip of substantially rigid material entirely embedded in said core against which a head of a fastener is adapted to contact when extending the fastener through the unit and strip of material and into the building for attaching the body to the building, said unit of construction material comprising an insulation sheet being formed of light-weight plastic material and including a rectangularly shaped body, and means for mounting said sheet onto such building or structure with headed fasteners, said mounting means for said sheet including a strip of substantially rigid material embedded in said sheet against which a head of a fastener is adapted to contact and be supported when extending the fastener through the sheet and into said building, and said mounting means further including a channel extending in said body substantially parallel to said back wall, whereby said channel receives said strip of substantially rigid material.

23. The combination according to claim 22, wherein said channel is an L-shaped channel formed by passing an L-shaped hot-wire through said body of said insulation sheet.

24. The combination according to claim 22, wherein said body further includes indica on said top wall of said body to facilitate the proper insertion points for said headed fasteners such that said headed fasteners pass through said strip of substantially rigid material.

25. The combination according to claim 24, wherein said markings is a line.

26. The combination according to claim 25, wherein said line is a dashed line.

27. A method for attaching a unit of construction material adapted to engage a building, wherein the unit includes a body of light-weight plastic, said method comprising: embedding an elongated strip of rigid material entirely in said body, and applying headed fasteners through the body and strip of rigid material that engage the building and where the heads of the fasteners contact and bear against said strip thereby attaching the unit to the building, said unit of construction comprising an insulation sheet for attachment to a substrate of an interior or exterior structure by fasteners, comprising the steps of:

forming a plastic material into a cross-sectional body with a base wall and an outer formed face;

forming a longitudinally extending channel through said body parallel to said base wall;

coating said outer formed face with a substantially rigid material; and inserting a strip of substantially rigid material into said channel to receive said fasteners for attaching said body to said substrate.

* * * * *

UNITED STATES PATENT AND TRADEMARK OFFICE

CERTIFICATE OF CORRECTION

PATENT NO. : 6,481,170 B1
DATED : November 19, 2002
INVENTOR(S) : Pavel Savenok et al.

It is certified that error appears in the above-identified patent and that said Letters Patent is hereby corrected as shown below:

Column 6,
Line 16, delete “wire”.

Signed and Sealed this

Eighteenth Day of March, 2003

JAMES E. ROGAN
*Director of the United States Patent and Trademark Office*